US010208528B2

(12) United States Patent
Sebastian et al.

(10) Patent No.: US 10,208,528 B2
(45) Date of Patent: Feb. 19, 2019

(54) FOLD-UP WINDOW HARDWARE

(71) Applicant: Caldwell Manufacturing Company North America, LLC, Rochester, NY (US)

(72) Inventors: Anthony Sebastian, Rochester, NY (US); Robert M. Lucci, Rochester, NY (US); Patrick Milligan, Rochester, NY (US); James McInnis, Hilton, NY (US); Beau Gillow, Holly, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 200 days.

(21) Appl. No.: 15/263,547

(22) Filed: Sep. 13, 2016

(65) Prior Publication Data

US 2017/0074028 A1 Mar. 16, 2017

Related U.S. Application Data

(60) Provisional application No. 62/218,827, filed on Sep. 15, 2015.

(51) Int. Cl.

| | |
|---|---|
| ***E05C 7/06*** | (2006.01) |
| ***E06B 3/48*** | (2006.01) |
| ***E05D 13/00*** | (2006.01) |
| ***E05D 15/26*** | (2006.01) |
| ***E05B 65/00*** | (2006.01) |
| ***E05D 5/04*** | (2006.01) |

(Continued)

(52) U.S. Cl.

CPC ..... *E06B 3/483* (2013.01); *E05B 65/0085* (2013.01); *E05D 5/04* (2013.01); *E05D 13/1276* (2013.01); *E05D 15/262* (2013.01); *E05B 53/00* (2013.01); *E05B 63/143* (2013.01); *E05Y 2900/148* (2013.01)

(58) Field of Classification Search

CPC ..... E05B 65/0085; E05B 63/143; E05B 65/0835; E05D 13/1276; E05D 15/262; E05D 15/00; E05D 15/264; E05D 15/266; E05D 15/04; E05D 15/02; E05Y 2900/148; E05Y 2900/00; E05F 15/51; E05F 15/53; E05F 15/57; E06B 3/44; E06B 3/5063

USPC ..... 49/176, 181, 188, 189, 162, 161; 160/224, 187, 89, 229.1

See application file for complete search history.

(56) References Cited

U.S. PATENT DOCUMENTS 1,399,323 A 12/1921 Schoellerman
1,757,048 A * 5/1930 Janeczko ..... E06B 3/2605 16/267

(Continued)

FOREIGN PATENT DOCUMENTS

| | | |
|---|---|---|
| CA | 2844650 | 11/2014 |
| GB | 532788 A | 1/1941 |
| WO | WO2008/117913 | 10/2008 |

*Primary Examiner* — Chi Q Nguyen
(74) *Attorney, Agent, or Firm* — Harness, Dickey & Pierce, P.L.C.

(57) ABSTRACT

A window assembly is disclosed that includes a double-hung window aesthetic with an alternative opening procedure and mechanism. The window assembly may include various hardware systems. The hardware systems may include locking portions to assist in locking sash members to a frame and balance assembly for moving the sash members. The window assembly may be formed of selected materials.

26 Claims, 10 Drawing Sheets

(51) Int. Cl.
*E05B 53/00* (2006.01)
*E05B 63/14* (2006.01)

(56) References Cited

U.S. PATENT DOCUMENTS 2,771,133 A * 11/1956 Haskell ..... E06B 3/483
160/107
2,879,841 A * 3/1959 Etten ..... E06B 3/28
16/267
3,464,157 A * 9/1969 Rodriguez ..... E06B 3/50
49/161
4,039,018 A * 8/1977 De Maria ..... E06B 3/2605
160/187
4,914,861 A * 4/1990 May ..... E05D 15/22
49/181
5,363,898 A * 11/1994 Sprague ..... E05D 13/1276
160/191
5,490,306 A * 2/1996 Floyd ..... E05D 11/0054
16/250
5,592,781 A * 1/1997 Mauro ..... E05B 65/0835
49/161
9,080,379 B2 * 7/2015 Guillemette ..... E05D 15/262
2013/0104458 A1 * 5/2013 Leung ..... E05C 17/28
49/13
2013/0214545 A1 8/2013 Wolf et al.
2017/0074028 A1 * 3/2017 Sebastian ..... E05B 65/0085

* cited by examiner

FOLD-UP WINDOW HARDWARE

CROSS-REFERENCE TO RELATED APPLICATIONS

This application claims the benefit of U.S. Provisional Application No. 62/218,827, filed on Sep. 15, 2015. The entire disclosure(s) of (each of) the above application(s) is (are) incorporated herein by reference.

FIELD

The subject disclosure relates to a window assembly, and particularly to hardware assemblies for a window.

BACKGROUND

This section provides background information related to the present disclosure which is not necessarily prior art.

A window assembly can include various types of assemblies where sashes move within a frame. The frame may have a jamb channel in which the window sashes slide or move. Balances may also be inserted into the jamb channels to assist in movement, such as carrying at least a portion of the weight of the window sashes, during movement of the window sashes. A double-hung window can include two window sashes where at least one of them moves vertically to open the window.

A window assembly that may mimic the view or look of a double-hung window, but may fold. The window may include two sashes within a frame where both sashes move to open the window to a greater extent than if one of the sashes moved in front of or behind the other sash. In doing so, both sashes may rotate (each around a separate pivot point or axis) and the two sashes may fold at a hinged portion to open the window. A folding window assembly is disclosed in U.S. Pat. No. 9,080,379, incorporated herein by reference.

SUMMARY

This section provides a general summary of the disclosure, and is not a comprehensive disclosure of its full scope or all of its features.

In various combinations, a window assembly may allow window sashes to fold up, thus forming a fold-up window assembly. The combination may include one or more window sashes that are mounted in a window frame. Various hardware components may be used in an assembled window assembly to allow the window to fold-up. The window may fold-up in an open configuration.

In a folding window assembly, a balance assembly and lock assembly may be provided to assist in guiding and moving sashes in a window frame. Hinge assemblies may be provided and positioned such that they are minimally intrusive when viewing the window and looking through the panes In various embodiments. For example, the hinges may include one or more leaves that have non-parallel sections and/or may be received in recesses or pockets formed in a rail of a sash and/or frame. The hinges may be formed and assembled such that the window assembly closely mimics a view of a traditional double hung window. In addition to the hinge assembly, a lock assembly may be provided to assist in holding sashes within the window frame. The lock assembly may also be formed to mimic traditional lock assembly double hung window configuration.

In various embodiments, a fold-up window assembly may include a frame, an upper sash, and a lower sash wherein the upper sash and the lower sash are configured to fold-up to an open configuration and unfold to a closed configuration. The fold-up window assembly may further include a balance assembly to assist in moving the lower sash at least to move the window assembly to the open configuration. The balance assembly may, therefore, include a case fixed to the frame above the lower sash when the window assembly is in the closed configuration and a spring member at least partially received within the case and coupled to the lower sash to apply a force to the lower sash. The fold-up window assembly may also include a first hinge assembly interconnecting the lower sash and the upper sash and a second hinge assembly interconnecting the upper sash and a header of the frame. At least the first hinge assembly and the second hinge assembly cooperate with the upper sash and the lower sash to allow the upper sash and the lower sash to fold and unfold relative to the frame. Moreover, the fold-up window assembly, having the balance assembly, may include a sash carrier and a friction enhancement member carried by the sash carrier and configured to engage a jamb channel of the frame to resist a spring force of the spring member. The lower sash interconnects to the spring member via the sash carrier. The balance assembly may further include a coil spring wound around a first axis as the spring member and the friction enhancement member includes a curved surface to engage the jamb channel to resist the spring force. The curved surface of the friction enhancement member is formed around a second axis that is perpendicular to the first axis.

In various embodiments, a hardware system for a fold-up window assembly having an upper sash and a lower sash includes a balance assembly having a spring member received within a case and coupled to the lower sash, a first hinge assembly to hingedly interconnect the upper sash and the lower sash having a first leaf connected to the lower sash, a second leaf connected to the upper sash, and a first hinge pin, and a second hinge assembly to hingedly interconnect the upper sash and the header of the frame having a third leaf connected to the upper sash, a fourth leaf connected to a header of the frame, and a second hinge pin. In the assembly, at least the first hinge assembly and the second hinge assembly cooperate with the upper sash and the lower sash to allow the upper sash and the lower sash to fold relative to the frame such that the upper sash rotates around the second hinge pin of the second hinge assembly near the header of the frame and the lower sash rotates around the first hinge pin as the upper sash and lower sash fold.

In various embodiments, a hardware system for a fold-up window assembly having an upper sash and a lower sash includes a slide locking assembly recessed in the lower sash and moveable to couple the lower sash to a frame of the window assembly. The slide locking assembly may engage a frame of the window assembly to assist in fixing the at least one of the upper sash or the lower sash to the window frame. The window assembly may further include a first hinge assembly interconnecting the lower sash and the upper sash and a second hinge assembly interconnecting the upper sash and a header of the frame. At least the first hinge assembly and the second hinge assembly cooperate with the upper sash and the lower sash to allow the upper sash and the lower sash to fold relative to the frame such that the upper sash rotates around a second hinge pin of the second hinge assembly near the header of the frame and the lower sash rotates around a first hinge pin as the upper sash and lower sash fold between a closed position and an open position.

In various embodiments, a hardware system for a fold-up window assembly having an upper sash and a lower sash may include a balance assembly having a case fixed to a frame above the lower sash when the window assembly is in a closed configuration and a spring member received within the case and coupled to the lower sash to apply a force to the lower sash. The window assembly may further include a first hinge assembly interconnecting the lower sash and the upper sash and a second hinge assembly interconnecting the upper sash and a header of the frame. In the window assembly, at least the first hinge assembly and the second hinge assembly cooperate with the upper sash and the lower sash to allow the upper sash and the lower sash to fold relative to the frame. Further, the spring member assists in moving the lower sash at least to move the window assembly to an open configuration.

In various embodiments, a window assembly may be assembled and/or installed with various components for a fold-up window assembly with a hardware system. The method may include installing a balance assembly in a frame configured to assist in moving a lower sash at least to move a window assembly to the open configuration in the frame. Further, installing a slide locking assembly recessed in the lower sash and moveable to couple the lower sash to the frame of the window assembly. Also, installing a first hinge assembly to interconnect the lower sash and an upper sash and installing a second hinge assembly to interconnect the upper sash and a header of the frame. Once installed the upper sash and the lower sash are configured to fold-up to an open configuration and unfold to a closed configuration. Further, at least the first hinge assembly and the second hinge assembly cooperate with the upper sash and the lower sash to allow the upper sash and the lower sash to fold relative to the frame such that the upper sash rotates around a second hinge pin of the second hinge assembly near the header of the frame and the lower sash rotates around a first hinge pin of the first hinge assembly as the upper sash and lower sash fold and unfold between the closed configuration and the open configuration.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
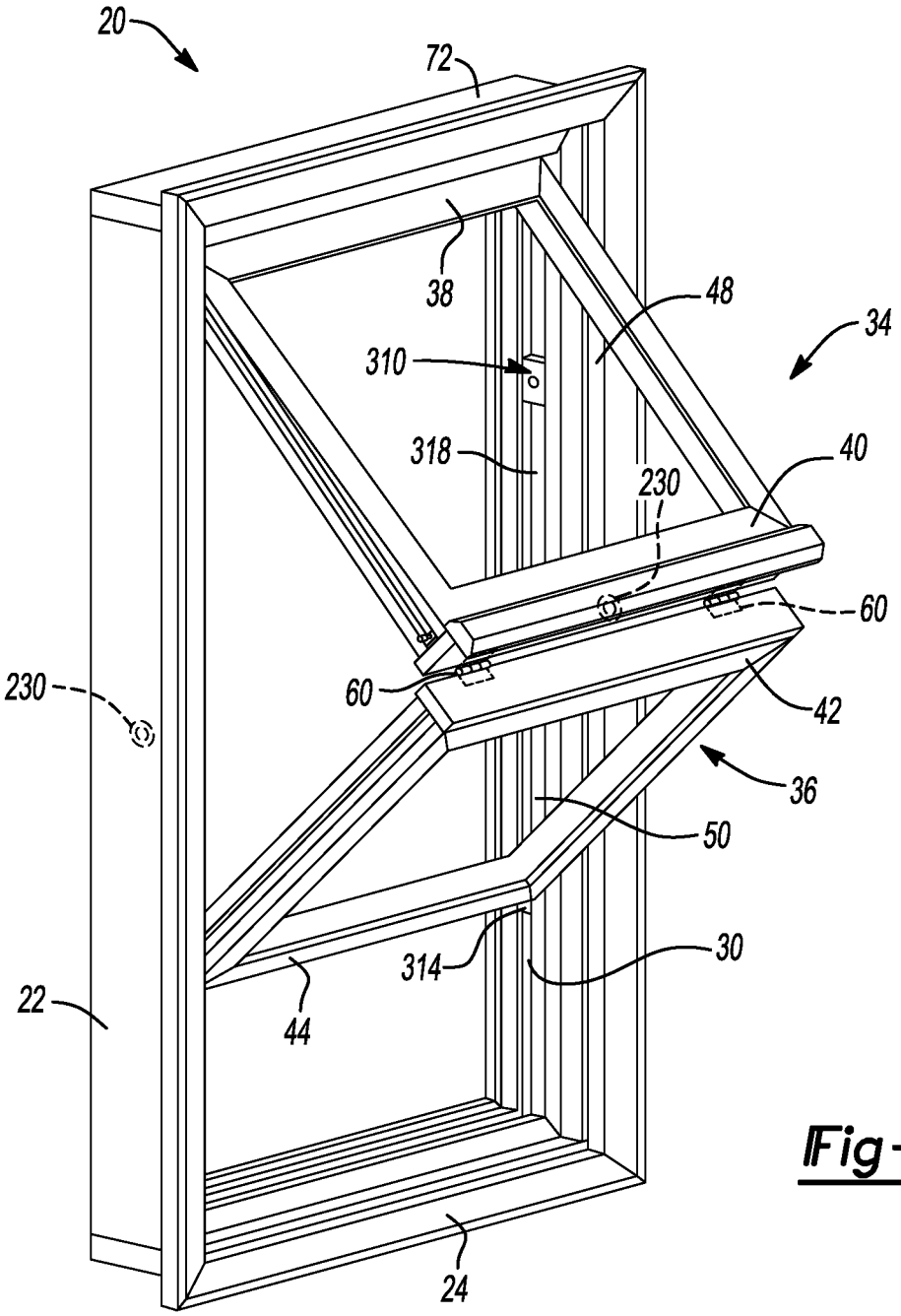
FIG. 1 is a partial open view of a window assembly having folding sashes.

With reference to FIG. 1, a window assembly 20 is illustrated in a partially fold-up or open configuration. The window assembly 20 may include a frame assembly or frame 22 and one or more trim portions 24 that surround the frame 22. The frame 22, such as at an internal wall can define one or more jamb channels 30. The jamb channel 30 allows guiding a member positioned within the jamb channel 30 to assist in moving and operating the window. In particular, the window assembly 20 can include a first or upper sash 34 and a second or lower sash 36. The upper sash 34 may be connected near an upper terminal end at an upper portion 38 of the upper sash 34 (which may include a pivot point as formed by a hinge assembly 70, discussed herein) within the frame 22. A lower end 40 of the upper sash 34 may be movably or hingedly connected (such as formed by a hinge assembly 60 as discussed herein) to an upper sash or rail portion 42 of the lower sash 36. A second terminal end or lower end 44 of the second sash member 36 can be movably interconnected with the jamb channel 30 of the frame 22.

As discussed further herein and illustrated in FIG. 1, the two sash members 34, 36 may be manipulated such that the upper sash portion 42 of the lower sash 36 and the lower portion 40 of the upper sash 34 move inward or away from the frame 22. This movement allows the lower portion 44 of the lower sash 36 to move towards the upper portion 38 of the upper sash 34. This movement allows the window assembly 20 to open as each of the sash members 34, 36 may include or be installed with a window pane 48, 50, respectively.

Figure 2:
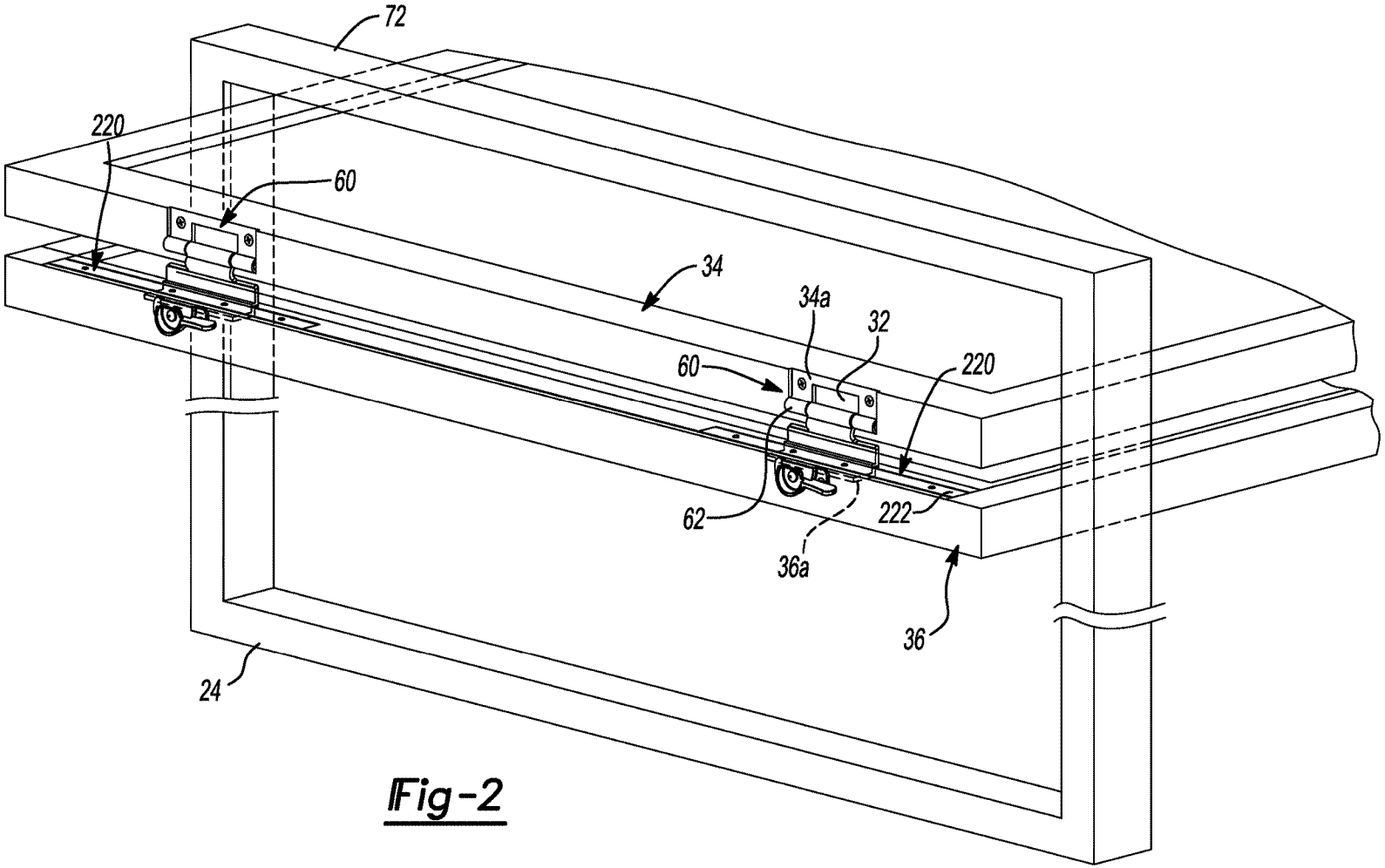
FIG. 2 is an internal perspective view of a window assembly of FIG. 1.
Figure 3:
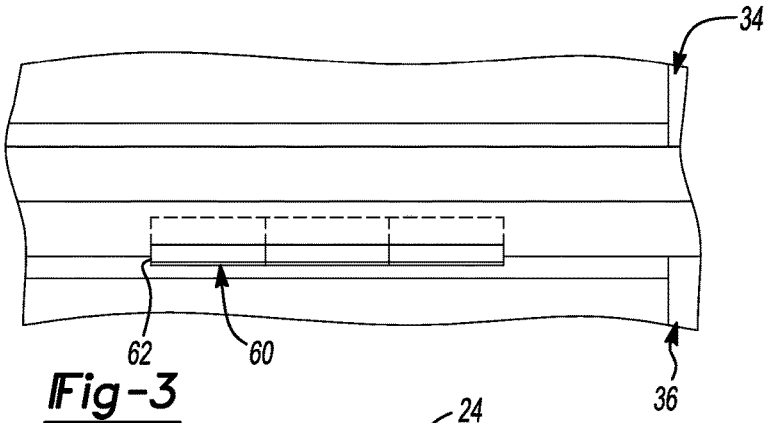
FIG. 3 is a detailed view of the hinge assembly in an installed and closed configuration.

The window assembly 20, as illustrated in FIG. 1, can include a hinge assembly 60 as illustrated in FIG. 2. The hinge assembly 60 can interconnect the upper sash 34 and the lower sash 36. As illustrated in FIG. 2, the upper sash 34 and the lower sash 36 are positioned in the folded (fold-up) position or open configuration relative to the window frame 22. The hinge assembly 60, therefore, may also be referred to as an intersash hinge assembly 60. The hinge assembly 60 includes a configuration, as discussed in detailed herein, that allows the hinge assembly 60 to be relatively indistinguishable from the surrounding sash components when in the unfolded or closed configuration, as illustrated in FIG. 3.

The configuration of the hinge assembly 60, alone and/or in combination with a configuration of the upper sash 34 and the lower sash 36, allows the relative indistinguishability. For example, the hinge assembly 60 may be recessed into a portion of the upper sash 34 and the lower sash 36. When recessed and/or configured only a minimal portion of a barrel 62 of the hinge assembly 60 is viewable. For example, the hinge assembly 60 may have a portion recessed into a first pocket 34*a* formed in a rail of the upper sash 34 and a portion recessed into a second pocket 36*a* (FIG. 2 and FIG. 11) of the lower sash 36. In this manner, for example when only the barrel or portion of the barrel is visible in the closed configuration (particularly from an interior of a structure where the window assembly is installed) allows the hinge assembly 60 to be relatively indistinguishable from the surrounding sash components. Thus, the aesthetic and view of the window assembly 20 may be identical to or closely resemble a double hung window in the closed configuration.

Figure 4:
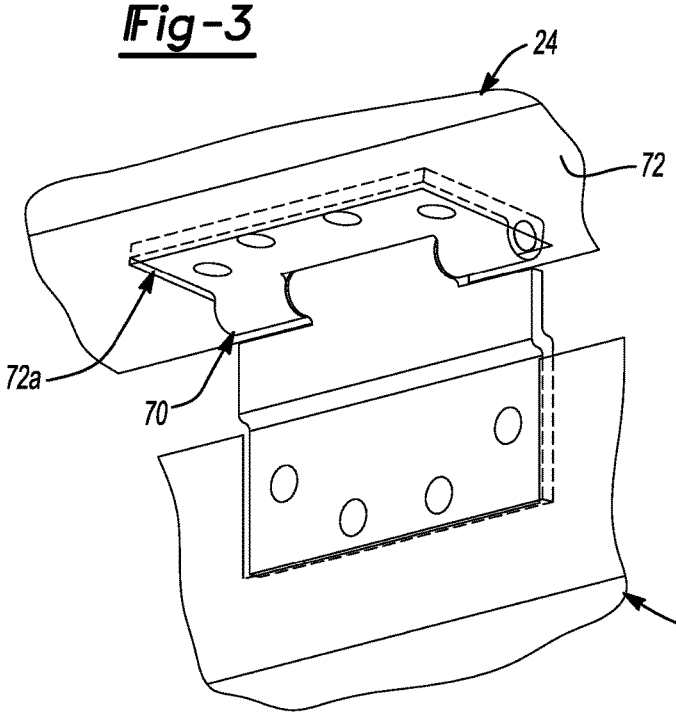
FIG. 4 is a detailed view of the hinge assembly between a header and an upper sash in an open configuration.
Figure 5:
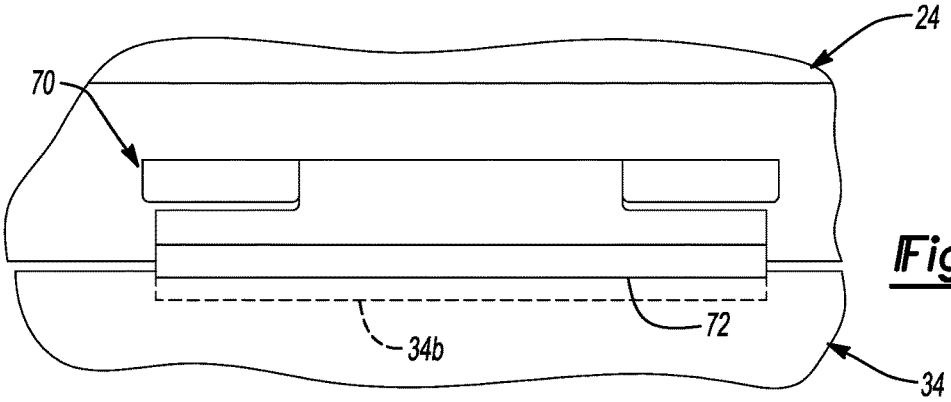
FIG. 5 is a detailed view of the hinge assembly between a header and an upper sash in a closed configuration.

The window assembly 20 may further include a hinge assembly 70, as illustrated in FIG. 4 that interconnects the upper sash 34 and a header or upper member 72 of the frame assembly 22. As illustrated in FIG. 4, the upper sash 34 is folded to expose the hinge assembly 70. FIG. 5 illustrates the hinge assembly 70 when the upper sash 34 is in a closed configuration relative to the frame assembly 22. Again, in the closed configuration the hinge assembly 70 is relatively hidden and relatively indistinguishable from the surrounding sash and frame components such that substantially only a barrel 166, 204 (FIGS. 8 and 9) or portion of the barrel 166, 204 of the hinge assembly 70 is viewable in the sash closed position. The configuration of the hinge assembly 70, alone and/or in combination with a configuration of the upper sash 34 and the header 72, allows the relative indistinguishability. Further, the hinge assembly 70 may be recessed into a portion of the upper sash 34 and the header 72 such that only a minimal portion of the barrel 166, 204 of the hinge assembly 70 is viewable in the closed position. For example, the hinge assembly 70 may have a portion recessed into a third pocket 34*b* formed in a rail of the upper sash 34 and a portion recessed into a fourth pocket 72*a* of the header 72.

Figure 6:
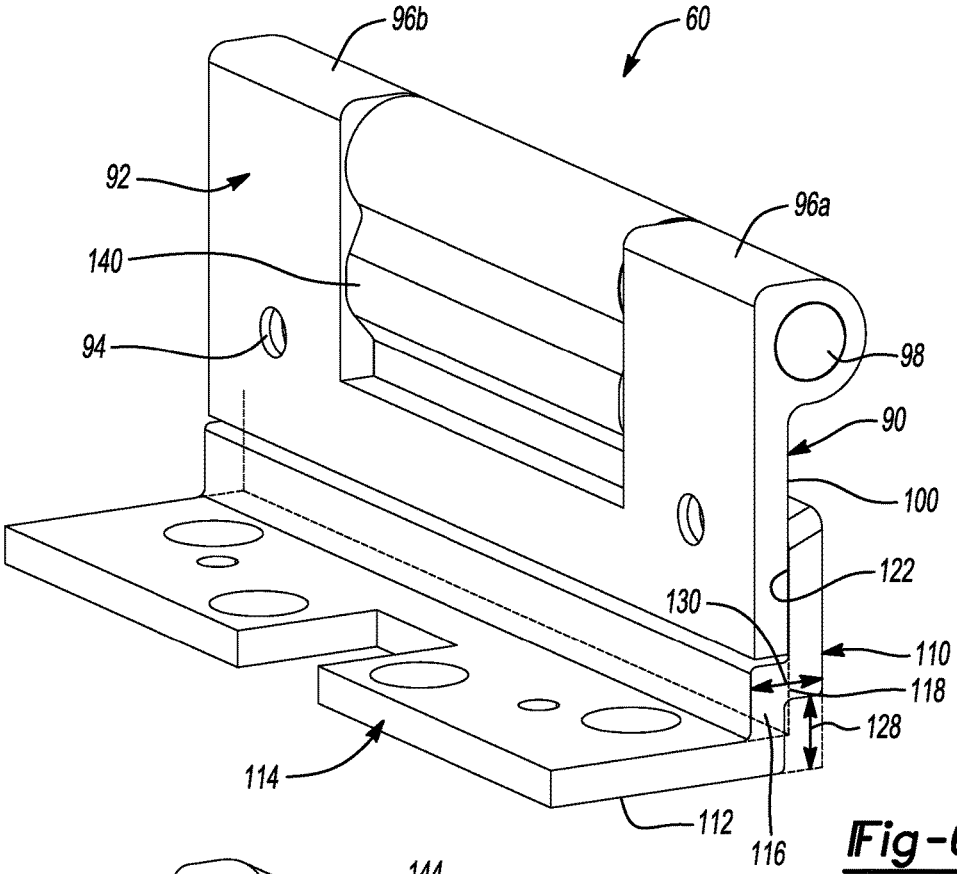
FIG. 6 is a perspective view of a hinge assembly.
Figure 7:
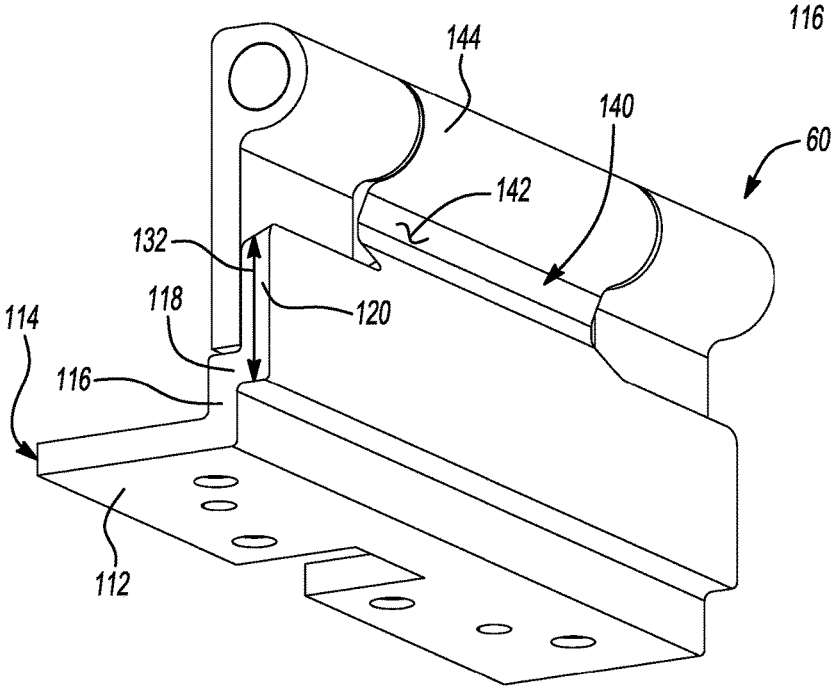
FIG. 7 is an alternative perspective view of the hinge assembly for FIG. 6.

With continuing references to FIGS. 1-5 and additional reference to FIGS. 6 and 7, the hinge assembly 60 is illustrated. The hinge assembly 60 includes a hinge leaf 90 that is configured to connect or contact the upper sash 34 on a sash contact surface 32, which may be formed in the pocket 34*a*, and includes one or more bores 94 to allow a screw or other connection member to pass through the leaf 90 to interconnect the leaf 90 with the upper sash 34. The leaf 90 includes a first barrel portion 96*a* and a second barrel portion 96*b*. Each barrel portion 96*a*, 96*b* includes a passage through which a hinge pin 98 may pass. Opposed to the sash contacting surface 92 is a back surface 100 that contacts a second or lower leaf portion 110, wherein the second leaf portion 110 contacts the lower sash 36 at a lower sash contacting surface 112, which may be formed in the pocket 36*a*.

The second leaf 110, in various embodiments, may include a geometry that includes a step shape or configuration. The lower leaf 110 includes a first leaf section 114 that extends at an angle, such as approximately a 90° angle relative to a second leaf section 116. The second leaf section extends from a third leaf section 118 that in turn extends from a fourth leaf section 120. Each of the leaf's sections 114, 116, 118 can extend generally 90° or substantially perpendicular to adjacent section. The fourth section 120 can be formed to be substantially parallel with the first leaf 90. When the window assembly 20 is in a closed configuration the fourth section 120 includes a leaf contacting surface 122 that contacts the back leaf surface 100 of the first leaf 90.

The second leaf section 116 may form a first height extending distance 128. The distance 128 may be from about zero inches to about 0.4 inches (about 10 millimeters (mm)), including about 0.29 inches (about 7.4 mm). The distance 128 may be provided to receive other portions of the window assembly, including a track 222 as discussed herein. The third leaf section 118 may extend a distance 130. The distance 130 may be about zero inches to about 0.2 inches (about 5 mm), including about 0.17 inches (about 4 mm). In a stepped configuration, as illustrated in FIGS. 6 and 7, either or both of the distances 128 and 130 may be greater than zero inches. It is understood, however, that in a non-stepped configuration that the distances 128 and 130 may be zero and the first leaf section 114 may appear to extend directly from the fourth leaf section 120, in a generally "L" shaped configuration, as shown in phantom in FIG. 6. The fourth leaf section 120 may extend a distance 132 that is about 0.5 inches (about 12 mm) to about 3.0 inches (about 77 mm), including about 0.5 inches (about 12 mm) to about 1.5 inches (about 38 mm). and may relate to sash thickness.

Extending from the fourth leaf section is a barrel connection section 140 that can include one or more surfaces that may form a bump or depression 142. The depression 142 is towards or away from the front surface 92 of the first leaf 90. A barrel 144 is formed at the end of the barrel connection 140. The barrel 144 may be aligned with the barrel sections 96*a* and 96*b* and the hinge pin 98 can be passed there through all of the barrel sections 144, 96*a*, and 96*b*.

The barrel depression 142 includes or provides a relief for the window sash 34. The depression 142 allows the hinge assembly 60 to achieve an appropriate configuration of the hinge assembly 60 relative to the window sashes in the open and closed configurations. In particular, the depression 142 assists or allows the configuration of the hinge assembly to be generally hidden when the window assembly is in the closed or unfolded (e.g. fold down) configuration. The depression 142 may have a selected dimension based on material (e.g. wood, vinyl, aluminum) of the sashes 34, 36 and various dimensions of the sashes.

Figure 8:
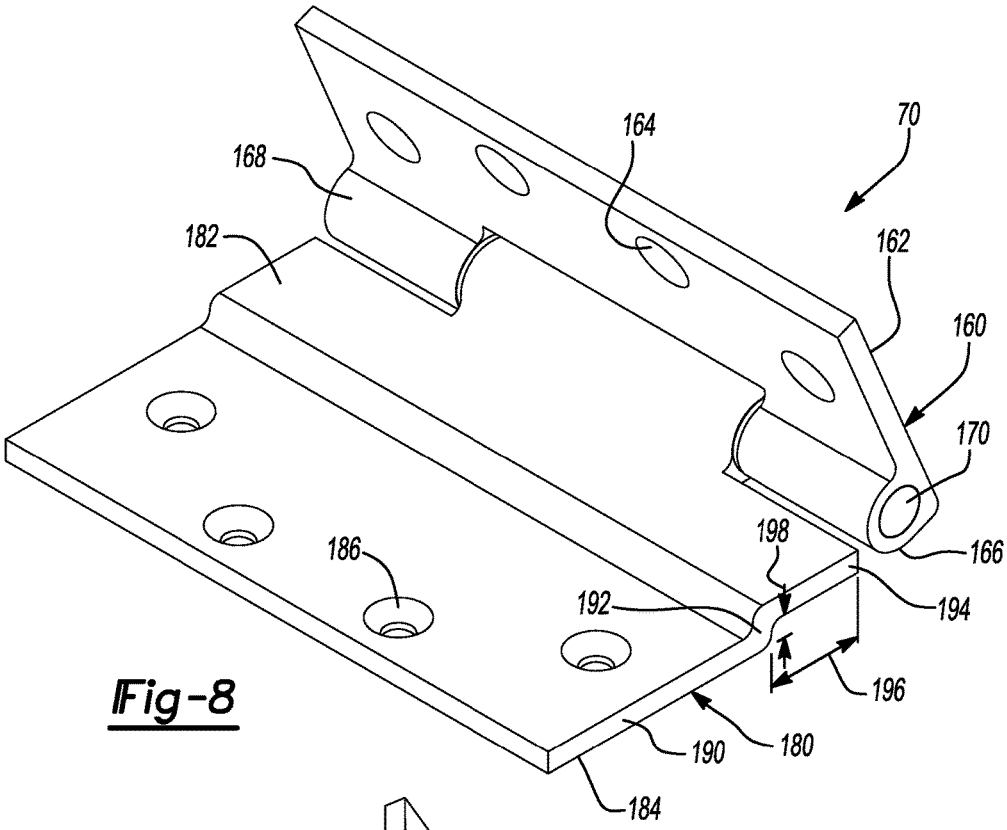
FIG. 8 is an open perspective of a hinge assembly.
Figure 9:
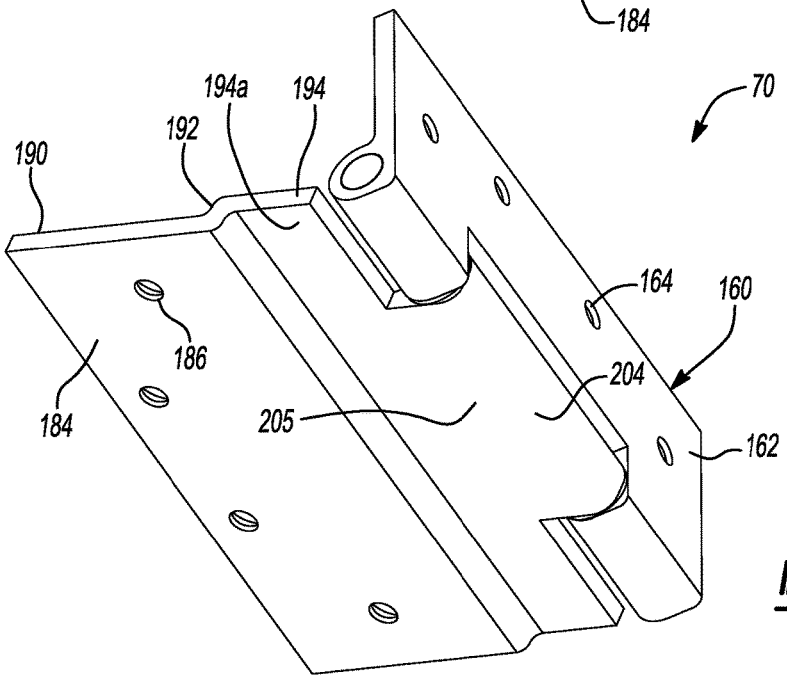
FIG. 9 is an open perspective view of the hinge assembly in FIG. 8.

With reference to FIGS. 4 and 5 an additional reference to FIGS. 8 and 9 the hinge assembly 70 is illustrated in detail. The hinge assembly 70 is the header hinge that connects the upper sash 34 to a top or a header portion 72 of the frame assembly 22. The hinge assembly 70 includes a first leaf member 160 that attaches to the header member 72 and has a header contacting surface 162, such as in the pocket 72*a*, through which bores, such as bore 164, are formed to allow passage of a fastener, such as a screw or bolt, to fix the leaf 160 to the header member 72. The first leaf 160 further includes barrel portions 166 and 168 through which a hinge pin 170 may pass.

The hinge assembly 70 further includes a second leaf 180 that has a first leaf contacting surface 182 to contact the first leaf 160 and a sash contacting surface 184 to contact the sash 34, such as in the pocket 34*b*. One or more bores 186 are formed through the sash contacting surface 184 to allow passage of fasteners, such as bolts and screws, to fix the hinge assembly 70 to the upper sash 34, as illustrated in FIG. 4.

The second leaf 180 may be stepped, as discussed herein. The sash contacting surface 184 is formed on a first section 190 of the second leaf 180 and extends generally perpendicular to a second section 192 of the second leaf 180. The first leaf contacting surface 182 is formed on a third section 194 of the second leaf 180. Each leaf section of the leaf sections 190, 192, 194 extends substantially perpendicular, such as at about a 90° angle from the section to which there connected. In various embodiments, the first section 190 of the second leaf 180, therefore is offset from the third section 194. Further, in various embodiments, substantially only the sash contacting surface 184 formed on the first section 190 contacts the upper sash 34, such as within the pocket 34*b*.

The third leaf section 194 extends a distance 196 from a terminal edge to the beginning of the second leaf section 192, as illustrated in FIG. 8. The distance 196 may be about 0.1 inches to about 1 inch. The second leaf section 192 extends a distance 198. The distance 198 may be about 0.1 inches to about 0.2 inches, including about 0.15 inches. The first section 190 can extend a selected distance from the second leaf section 192, such as a distance great enough to securely engage the upper sash 34.

Extending from the third leaf section 194 is a second leaf barrel portion 204. The second leaf barrel portion 204 includes a through bore passage to receive the hinge pin 170. Therefore, the hinge pin 170 connects the first leaf 160 and the second leaf 180. The second leaf barrel portion 204 may include a portion or surface 205 that extends in a plane with a bottom surface 194*a* of the third leaf section 194.

Figure 10:
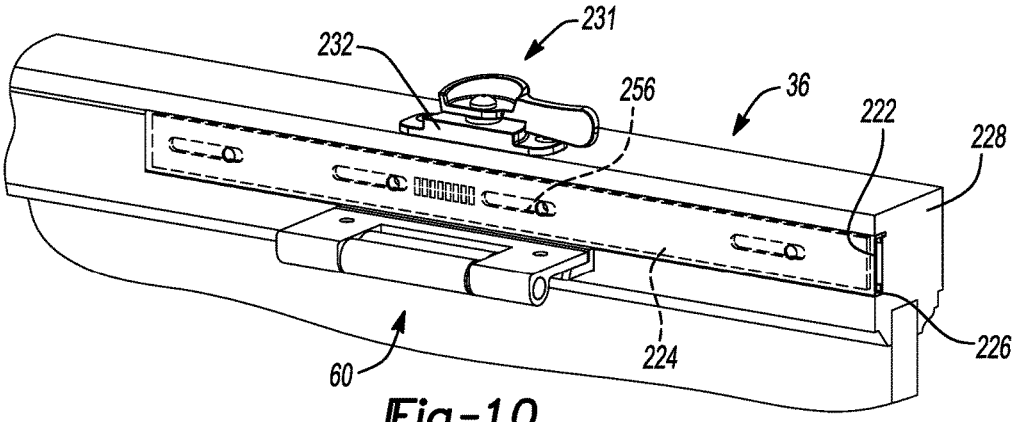
FIGS. 10 and 11 show alternative perspective views of an assembled and installed locking assembly.
Figure 11:
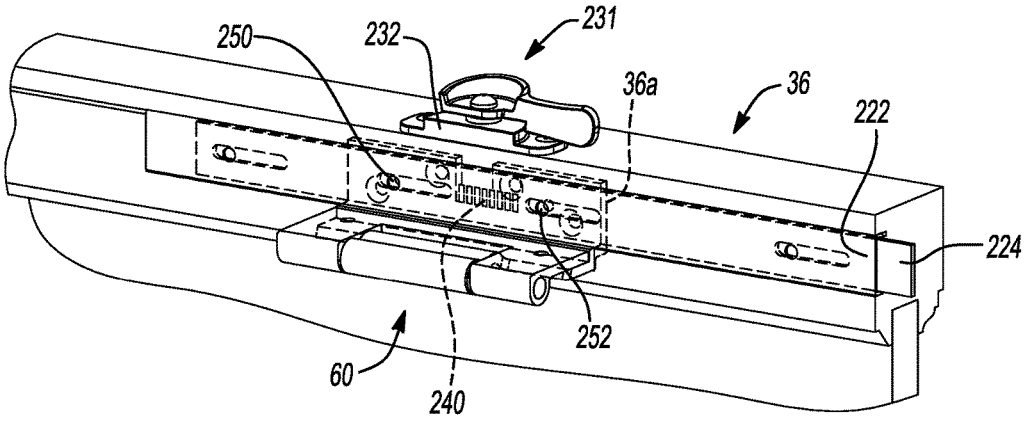
Figure 12:
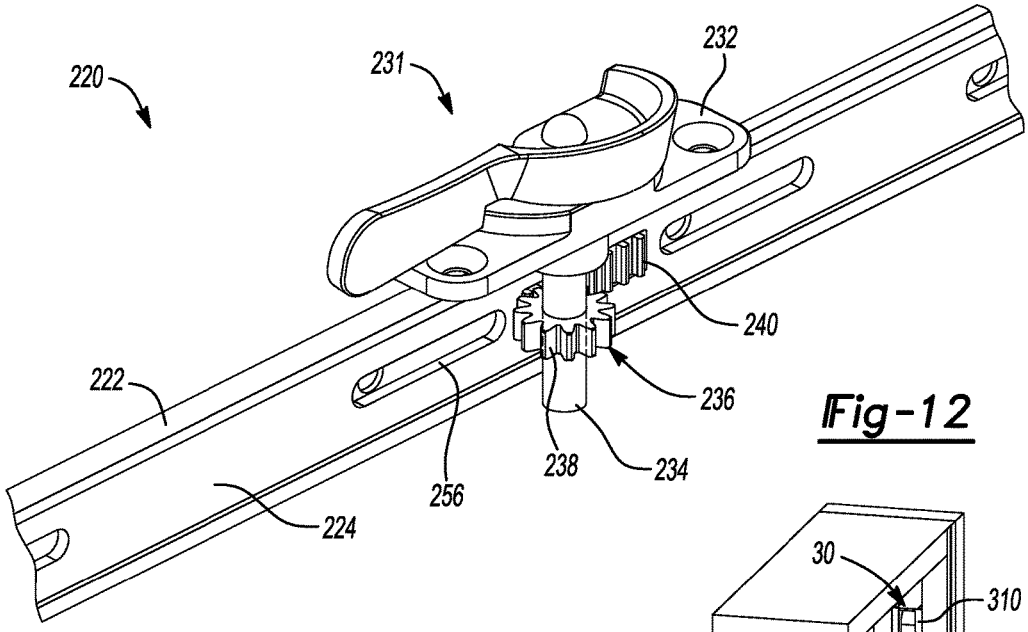
FIG. 12 is a perspective view of an assembled and non-installed locking assembly.

With continuing reference to FIG. 1 and additional reference to FIGS. 10, 11, and 12, the window assembly 20 further includes a latch or locking assembly 220, as illustrated in FIG. 10. The latch assembly 220 may be slide locking assembly, as discussed herein. The latch assembly 220 may include a latch casing or track member 222 and a locking bar 224 movable relative to the track member 222. At least the track member 222 is fit within a groove or recess 226 formed into an upper rail 228 of the lower sash 36. The placement within the groove 226 allows the lower sash 36 to lie flush against the upper sash 34 when in the closed configuration. Thus, the two sashes can contact one another and provide an appropriate storm sealed.

In addition, the latch assembly 220 may assist in locking the window assembly 20 in the closed position, such that both sashes cover the opening of the frame 22. The locking bar 224 can be moved, as discussed further herein, to engage a catch member or socket 230 formed in the frame assembly 22. The socket 230, as illustrated in FIG. 1, can be a separate member such as a metal insert or other material inserted into the frame assembly 22. Alternatively, or in addition to an insert, the socket 230 may be a blind bore or depression formed in the frame assembly 22, such as near the jamb channel 30.

As discussed further herein, when the window is in the closed configuration the locking bar 224 can be moved to engage in the socket 230 to lock the window in the closed configuration. Further by engaging the window frame 22 with the locking bar 224, which is connected to the sash 36, a further connection point between the sash 36 and the frame assembly 22 is created. Further, due to the interconnection of the lower sash 36 and the upper sash 34 with the hinge assembly 60, the upper sash 34 is also interconnected with the frame 22 via the locking assembly 220. It is understood, as illustrated in FIG. 2, a plurality of the hinge assembly 60 and a plurality of the locking assembly 220 can be provided in the window assembly 20. For example, as illustrated in FIG. 2, two of the hinge assembly 60 and two of the locking assembly 220 are provided in the lower sash 36 to assist in interconnecting the upper sash 34 and the lower sash 36 and locking the sash to 34, 36 to the frame 22.

With reference to FIGS. 10, 11, and 12 the lock assembly 220 further includes an actuator or catch member 231 that is moveably connected to a plate 232, as illustrated in FIG. 2. The plate 232 is fixed to the lower sash 36. In particular, the plate 232 may have one or more screws pass therethrough to hold the plate 232 to the lower sash 36.

An axle 234 extends from the catch member 231 and has a gear 236 connected thereto. Movement of the handle 231 rotates the axle 234, which in turn rotates the gear 236. The gear 236 includes one or more teeth 238 that engage a rack or toothed member 240. The rack member 240 is fixed within or fixed to the locking bar 224. Therefore, rotation of the gear 236 moves the rack member 240, which in turn moves the locking bar 224. By rotating the handle 231, therefore, the locking bar 224 can be moved to engage and disengage the locking bar 224 from the socket 230. This allows the locking assembly 220 to lock and unlock the window assembly, including the upper and lower sashes 34, 36 from the window frame 22.

As illustrated in FIGS. 10 and 11, the track member 222 and the locking bar 224 fits within a groove 226 formed in the lower sash 36. As discussed above, the hinge assembly 60 is also connected to the lower sash 36. The hinge assembly 60, and in particular the leaf member 110, includes a geometry or shape to allow the locking assembly to be positioned within the lower sash 36 while the lower sash 36 remains flush with an outer surface of the upper member 228. Therefore, the track member 222 and the locking bar 224 are positioned within a depression or the geometry of the hinge assembly 60, as illustrated in FIGS. 10 and 11. Further, the locking assembly 220 can include one or more passages that allow it to be fixed to the lower sash 36, such as a first fixation passage 250 and a second fixation passage 252. The first and second fixation passages 250, 252 may be aligned with passages through the leaf section 114 of the hinge assembly 60 to allow the locking assembly 220 and the hinge assembly 60 to be fixed to the lower sash 36 with a common fixation member. The locking bar 224 may include one or more grooves 256 to allow the locking bar 224 to move relative to the hinge assembly 60 to engage and disengage the sockets 230. The grooves 256 allow the locking bar 224 to move even when a fastener is passed through the locking bar 224 to fix the locking assembly to the sash 36.

Figure 13:
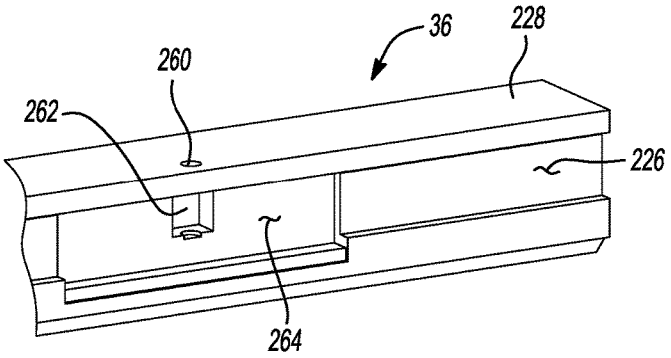
FIG. 13 is a perspective view of a sash portion prepared for receiving a locking assembly.

The handle member 231 may be assembled in pieces to achieve the selected aesthetic view of the window assembly 20. With continuing reference to FIGS. 10 and 11, and additional reference to FIG. 13, the lower sash 36, including the upper member 228, may include the groove 226 formed therein. A bore 260 is also formed through the top portion of upper member 228 at least a distance into the upper member 228 to form a blind bore or depression 262. A further depression or recess 264 is formed within the upper sash member 228 to receive at least a portion of the leaf member 110 of the hinge assembly 60. Therefore, the recess 264 may include depressions or sections that are a reverse image or imprint of a profile of the leaf member 110 of the hinge assembly 60.

The depressions and bores formed in the sash 36 allow the gear 236 to be positioned within the bore 262. The axle 234 may then be passed through the bore 260 and engaged within the gear 236. The top plate 232 and the handle member 231 may then be assembled to the axle 234 that extends through the bore 260 and into the blind bore 262. Therefore, the handle 231, axle 234, and the gear 236 can be assembled during installation of the locking assembly 220 onto the window sash 36. The hinge assembly 60 can then be positioned and fixed to the upper member 228 and then the track member 222 and the locking bar 224 can be assembled to the upper member 228 over the hinge assembly attached to the sash assembly 36. In this way the hinge assembly 60 and the locking assembly 220 can be assembled to the window sash 36. As discussed above, however, a plurality of the locking assemblies 220 and hinge assemblies 60 can be attached to the window sash 36.

Figure 14:
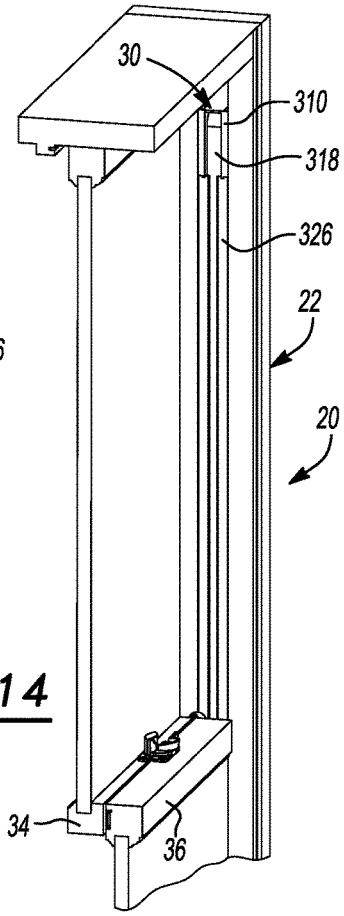
FIG. 14 is a partial environmental view of a closed window assembly.
Figure 16:
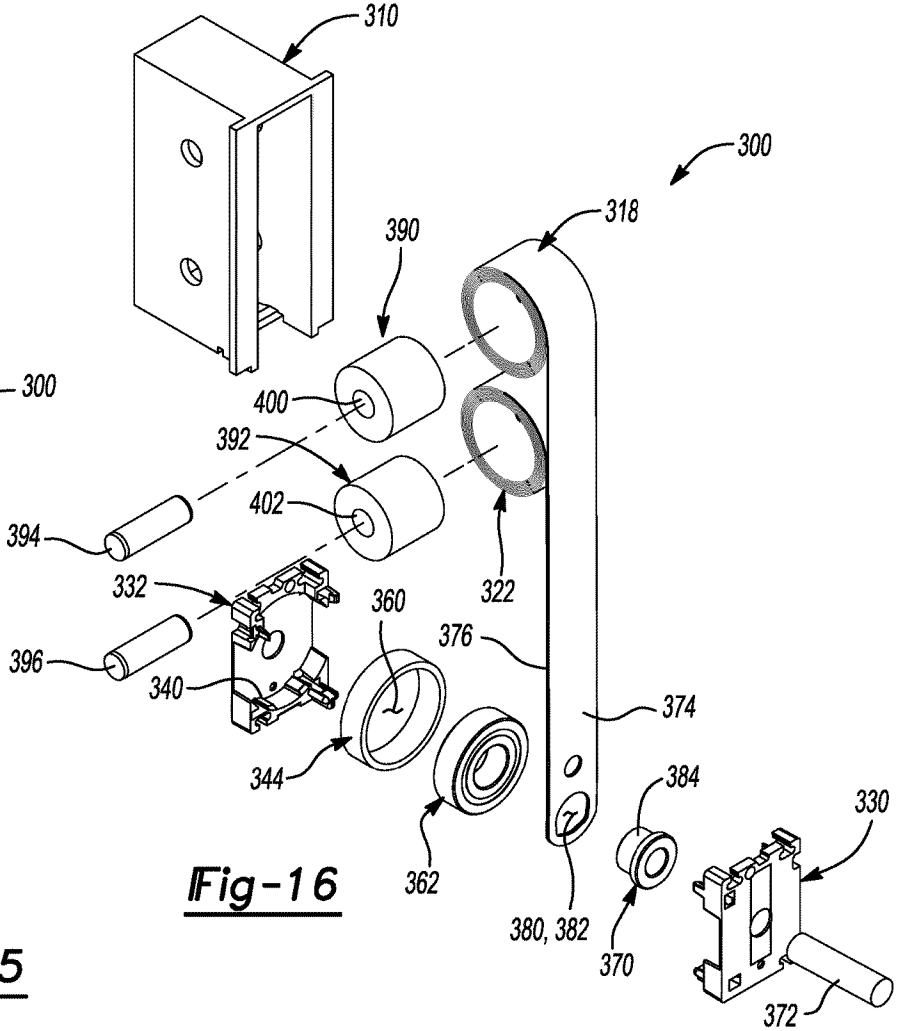
FIG. 16 is an exploded perspective view of an extended balance assembly of FIG. 15.
Figure 15:
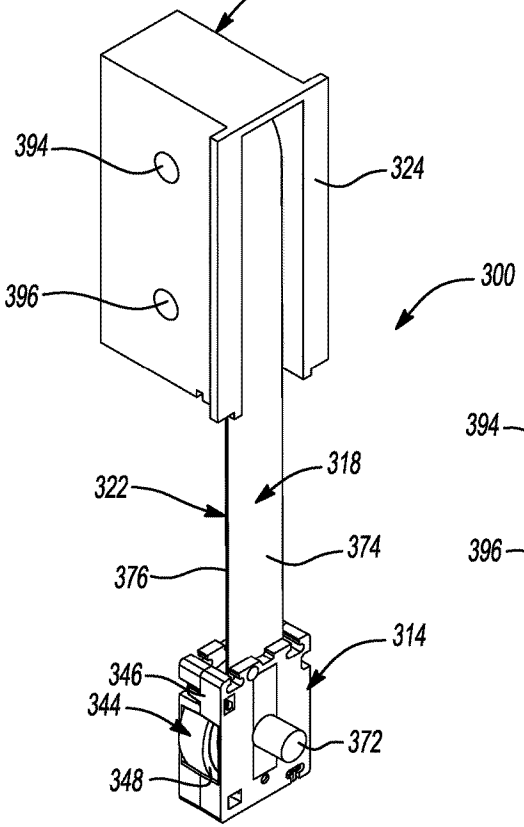
FIG. 15 is a perspective view of an extended balance assembly.

Returning reference to FIG. 1 and additional reference to FIGS. 14, 15, and 16 a balance assembly 300 is usuable to assist in operating the window assembly 20, such as in opening the window assembly (as illustrated in FIG. 1 partially open) and closing the window assembly as illustrated in FIG. 14. The balance assembly 300 may include a spring housing or casing 310, a sash carrier or carrier assembly 314, and one or more balance springs 318 and 322.

The balance assembly 300 is positioned within the jamb channel 30 of the frame assembly 22. As illustrated in FIG. 14, the spring housing 310 can be mounted at a location that is above the lower sash 36 and near a portion of the upper sash 34. In particular, the spring housing may be mounted in the jamb channel 30 between the header 72 and the lower sash 36 when the window is in the closed configuration. The spring housing 310 can be mounted in the jamb channel 30 and relative to the jamb channel 30 in the frame 22 according to appropriate mechanism such as with screws, bolts, rivets, or other appropriate connection portions. In addition, the spring housing 310 may be placed in a recess to hold the spring housing 310 with no separate fastening member. Thus, the spring housing 310 may be held in place with a friction or interference fit between the housing 310 and a recess or depression formed in the frame by the jamb channel 30. It is understood, that the window assembly 20 may include more than one balance assembly 300. For example, a balance assembly 300 may be provided on both sides of the frame assembly 22 and a jamb channel 30 may be provided on both sides.

The jamb channel 30 can include a depth to substantially receive the spring casing 310 such that the spring casing 310 is fully received or has an outer surface 324 that is flushed with an outer surface of the jamb channel 30. Therefore the spring housing 310 can be substantially hidden and/or covered by the jamb channel 30 or a covering such as a flashing or trim 326. The jamb channel 30 may include various features, including those discussed further herein, such as a surface covering or insert increase wear resistance of the jamb channel 30.

With continuing reference to FIGS. 14, 15, and 16 the balance assembly 300 further includes the sash carrier 314. The sash carrier 314 may, optionally, include a carrier housing that includes a first housing or case portion 330 and a second housing or case portion 332. Each of the two case portions 330, 332 may be members that interconnect with various interconnecting portions including fingers and respective indentations to be connected together. A friction adjustment, such as a threaded member or screw, may also moveably interconnect the two case members 330, 332 to move them a part to increase contact with the jamb channel 30, and thereby increase friction. The increased friction of the case members 330, 332 may resist a spring force applied by the springs 318, 322 to move the sash members 34, 36.

Further the case members 330, 332 can each include at least one respective guiding or contact surface 340 to engage a friction enhancement member 344. The friction enhancement member 344 can include an annular member formed of a selected material. The friction enhancement member 344 may be formed of a natural or synthetic annular rubber. The member 344 has an external radius that allows it to extend beyond an external surface 346 of the assembled carrier 314. As illustrated in FIG. 15, the friction enhancement member 344 includes at least a portion 348 that extends beyond the external surface 346 of the case members 330, 332. The friction enhancement member 344 can engage the jamb channel 30 to increase a friction and resist a spring force applied by the springs 318, 322. The size of the friction enhancement member 344, the inclusion of the friction enhancement member 344, the materials selected for the friction enhancement member 344, and other characteristics may be considered when determining the amount of friction to be applied to resist the force of the springs 318, 322.

Positioned within an opening 360 of the annular friction enhancement member 344 is a roller bearing 362. The roller bearing 362 may, alternatively, be provided in the members 330, 332 without the friction enhancement member 344. Nevertheless, the roller bearing 362 may fit snuggly within the friction enhancement member 344 such that the friction enhancement member 344 rotates around a bushing member 370 or pin 372 within the sash carrier housing 314. A pin or axle 372 may extend from the sash 36 and pass through at least a portion of the bushing 370. The force of the springs 318, 322 can therefore be transferred to the sash 36 through the busing 370 engaging the pin 372. It is understood, however, that other sash connection mechanisms can be provided and a pin 372 is simply exemplary. It is further understood that the case members 330, 332 need not be provided and that the springs 318, 322 may engage the pin 372 without the housing members 330, 332. Also, the friction enhancement member 344 may be eliminated.

The springs 318, 322 can each include a constant force coiled or rolled spring that include tail portions 374 and 376 and each include a passage bore 380, 382. The bushing 370 can include an outer surface 384 that contacts at least a portion of the respective tail portions 374, 376 after passing thought the passages 380,382. In this way the springs 318, 322 are captured within the housing members 330, 332. The spring tail 374, 376 extends from the housing members 330, 332, as illustrated in FIG. 15, and extends to the coil portion within the spring casing or housing 310.

The springs 318, 322 may be coil springs (e.g. flat coil springs) and can each be coiled around a roller or bushing 390, 392, respectively. In various embodiments the springs 318, 322 may be coiled and the bushings 390, 392 may be pressed fit within the coiled portions of the springs 318, 322. Axle pins 394, 396 may then be passed through bores 400, 402 of the bushings 390, 392. The pins 394, 396 can engage external walls of the spring casing 310, as illustrated in FIG. 15. Although bushings 390, 392 are pressed fit within the springs 318, 322, the bushings 390, 392 may rotate on the pins 394, 396 and the pins 394, 396 may rotate relative to the spring casing 310. Therefore, the springs 318, 322 may rotate as they are let out or retract during use of the balance assembly 300.

As illustrated in FIG. 14 the spring housing 310 is positioned within the jamb channel 30 such that the spring pins 394, 396 generally extends perpendicular to a long axis or length of the jamb channel 30. Therefore the spring members 318, 322 are let out or retract from the spring housing 310 such that a flat surface is facing the interior of the frame assembly 22. Further, as discussed above, the trim member 326 can be positioned at least over a portion of the jamb channel 30 to cover the spring members 318, 322 within the jamb channel 30. Further, as illustrated in FIGS. 15 and 14 the roller bearing 362 and the friction enhancement member 344 generally rotate along an axis that is perpendicular to the axis around with the springs 318, 322 rotate. In other words the long axis of the pin 394, 396 is generally perpendicular to the axis of the pin 372 that engages the sash 36.

Further, as illustrated in FIG. 14, the pin 372 generally extends from the lower sash 36. The spring housing 310 is generally positioned above or in an area where the sash will move when the window is opened, as illustrated in FIG. 1. The force of the springs 318, 322, therefore, can assist in moving the lower sash towards the header 72 of the frame assembly 22 and, in the process, cause the sash members 34, 36 to "fold" due to the hinge assembly 60 interconnecting the upper sash 34 and the lower sash 36 and hinge assemblies 70 interconnecting the upper sash 34 and the header portion 72 of the frame assembly 22. As discussed above the friction between the sash carrier 314 may be adjusted by adjusting the housing members 330, 332 and adjusting the friction enhancement member 344 to achieve an appropriate balance force relative to the force to open the window sashes 34, 36. Also the amount of friction and the force of the balance assembly 300 can be used to ensure that the sash members 34, 36 are appropriately opened and positioned once the window assembly 20 is opened.

It is understood that any selected number of the spring members can be positioned and engaged to the sash 36. For example, the spring housing 310 can be provided to hold three, four, or any appropriate number of spring members. Each of the spring members can include respective tails that are engaged to the sash assembly 36 in a manner similar to that illustrated above. Therefore, the spring force applied to the sash member 36 can be adjusted according to the various techniques.

Figure 17:
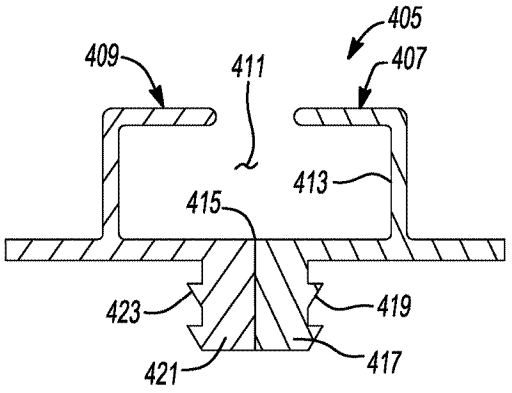
FIG. 17 is a cross sectional view of a jam channel insert.

With continuing reference to FIG. 14 and additional reference to FIG. 17, as discussed above, the jamb channel 30 may include an insert 405. The insert 405 may include a first piece 407 and a second piece 409. The two pieces 407, 409 may include members that extend along at least a portion of the length of the jamb channel 30, such as an entire length of the jamb channel 30, or only the portion along which the sash carrier 314 would travel of the frame assembly 22. The insert 405, therefore, may define a jamb channel insert portion 411 in which the carrier 314 moves. For example, the jamb channel insert portion 411 may include a dimension that allows the carrier assembly 314 to move therein, and allows the friction enhancement member 344 to contact at least one interior surface 413 through adjust the friction within the channel insert 405.

The two members 407, 409 may contact at a seam or contact surface 415 between the two members 407 and 409. Further a barb or engaging portion may extend from each of the members 407, 409. For example a first barb member 417 may extend from the first member 407 and include at least one or more barb portions 419. The barb portion 419 can extend from a surface and resist removal of the member 407 from the jamb channel 30. The second member 409 can include a similar, although mirror portion, such as a second barb member 421 that includes one or more barb portion 423.

During assembly the first member 407 can be moved into the channel 30, which may include a groove or depression, to receive the barb portion 417. The second channel member 409 may then be inserted separately to allow for maneuvering of the barb portion 421 relative to the barb portion 417 within the channel 30. The channel insert 405, therefore, can be inserted into the jamb channel 30 as two members.

The channel insert 405 may be inserted for selected purposes. For example, the frame assembly 22 may be formed of a wood while the channel insert 405 is formed of a metal, such as stainless steel, aluminum, or other selected metals or alloys. The channel insert 405 can therefore resist wear for a longer period of time than selected wood portions.

In light of the above, the window assembly 20 can therefore be assembled and inserted into a structure, such as a home or other building to substantially mimic a double hung window aesthetic while having a feature to allow a greater opening through the window frame 22. For example, in the folded configuration both the upper sash 34 and the lower sash 36 may be above the midline of the window assembly 20. In a double hung window assembly such an opening may not be possible. Further, the hinge assemblies 60 and 70 can be provided to substantially eliminate visualization of the respective hinge assemblies when the window at least is in the closed configuration. Further the locking assembly 220 and the balance assembly 300 can assist in the operation in the window assembly 20. The locking assembly 220 can increase a design pressure of the window assembly 20 and assist in securing the window sashes 34, 36 relative to the window frame 22. Further the balance assembly 300 can assist in operation of the window assembly 20, such as an opening and closing the window sashes 34, 36.

Figure 18:
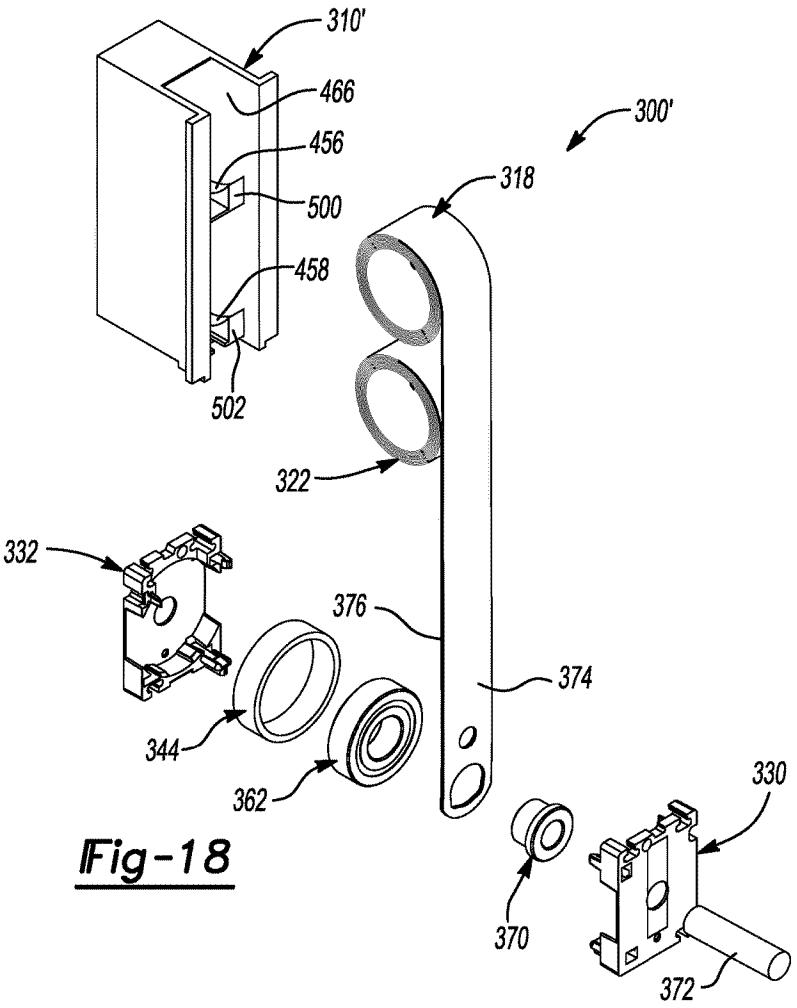
FIG. 18 is an exploded view of a balance assembly.
Figure 20:
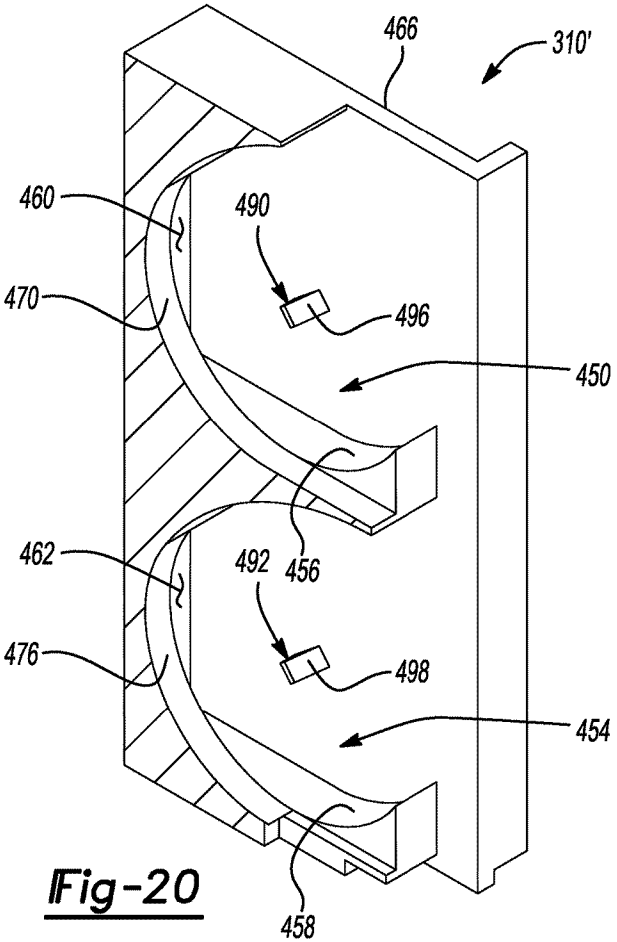
FIG. 20 is a cross-sectional view taken along lines FIG. 20-FIG. 20 from FIG. 19.
Figure 19:
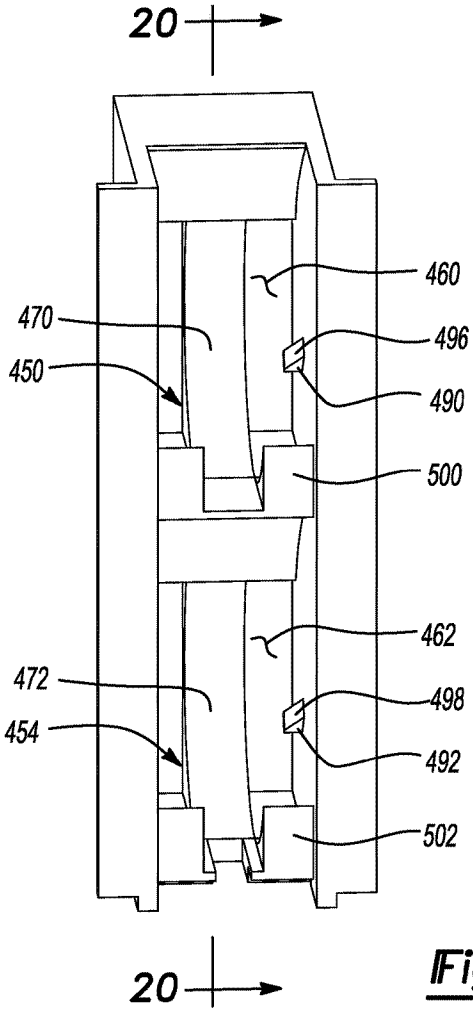
FIG. 19 is a detail view of a spring housing illustrated in FIG. 19.

With reference to FIGS. 18, 19, and 20 a balance assembly 300' is illustrated. The balance assembly 300' is similar to the balance assembly 300 illustrated in FIGS. 15 and 16 and similar parts are given the same reference numerals and will not be discussed in detail below. The balance assembly 300' includes a spring housing or casing 310' that is different from the spring housing or casing 310 of the balance assembly 300.

The spring housing or casing 310' includes at least one nest, such as a first nest 450 and a second nest 454. Each nest 450, 454 allows at least one of the selected spring member 318, 322 to rest and/or move on a respective surface 456, 458. The spring may ride on the surfaces 456, 458 rather than being placed on the hubs 390, 392 in the balance assembly 300. The elimination of the hubs allows for the elimination of the pins 394, 396. Thus, noise associated with these components is also eliminated. A selected lubricant or the material of the surfaces 456, 458 may be self-lubricating to assist in reducing noise further during let out and return of the tails 374, 376. it is further understood, that only one spring or more than two springs and respective nests may be provided.

The nests 450, 454 may include right and left surfaces 456, 458 or may include a continuous surface. A back nest surface 470, 472 may also be provided for each of the nests 450, 454. The back nest surfaces 470, 472 may separate respective right and left portions of the surfaces 456, 458. The casing 310' may further include openings 460, 462 to assist in forming the casing 310' as a single piece molded member. The nests 450, 454 and the openings 460, 462 may be formed between sidewalls 466 of the casing 310'. The openings 460, 462 may further be formed on either side of the back nest surfaces 470, 472.

Extending from the sidewall 466 may be one or more projections 490, 492. One projection may be provided for each nest 450, 454, but more than one may be provided for each nest 450, 454. Each of the projections 490, 492 may include a respective ramp surface 496, 498. The spring members 318, 322 may be inserted into the casing 310' past the projections 490, 492 by riding on the ramp surfaces 496, 498. The projections 490, 492 may assist in holding the springs 318, 322 within the casing 310' during installation and use of the balance assembly 300'.

The springs 318, 322, as illustrated in FIG. 18, let out over a surface 500, 502 of the respective nests 450, 454. Thus, the springs 318, 322 may have the respective tails 374, 376 captured by the pin 372. The pin 372 extends along an axis perpendicular to an axis of rotation of the springs 318, 322 within the casing 310'. Thus, installation and operation of the balance 300' may be similar to the balance assembly 300. This configuration may make installation and removal of the balance assemblies 300, 300' efficient.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hardware system for use with a fold-up window assembly having an upper sash, a lower sash, and a frame, the hardware system comprising:

a balance assembly having a spring member received within a case and couplable to the lower sash;

a first hinge assembly configured to hingedly interconnect the upper sash and the lower sash, the first hinge assembly having a first leaf configured to connect to the lower sash, a second leaf configured to connect to the upper sash, and a first hinge pin; and a second hinge assembly configured to hingedly interconnect the upper sash and a header of the frame, the second hinge assembly having a third leaf configured to connect to the upper sash, a fourth leaf configured to connect to the header of the frame, and a second hinge pin;

wherein at least the first hinge assembly and the second hinge assembly are configured to cooperate with the upper sash and the lower sash to allow the upper sash and the lower sash to fold relative to the frame such that the upper sash rotates around the second hinge pin of the second hinge assembly near the header of the frame and the lower sash rotates around the first hinge pin as the upper sash and lower sash fold.

2. The system of claim 1, wherein the first hinge assembly is configured to be relatively indistinguishable from the lower sash and the upper sash when in an unfolded configuration.

3. The system of claim 2, wherein the second leaf includes a first surface to contact the upper sash and a second opposed surface to contact the lower sash and the first leaf, wherein the first leaf contacts the lower sash at a lower sash contacting surface.

4. The system of claim 3, wherein the first leaf includes at least a first section extending about 90 degrees relative to a second section.

5. The system of claim 4, wherein the first leaf includes a third section, wherein the third section extends substantially parallel with the second section.

6. The system of claim 5, wherein the first leaf includes a fourth section extending between the second section and the third section;

wherein the fourth section extends substantially about 90 degrees relative to both the second section and the third section.

7. The system of claim 2, wherein the second leaf includes a barrel depression configured to provide a relief for the upper sash in an unfolded configuration.

8. The system of claim 1, wherein the second hinge assembly is configured to be relatively hidden when the upper sash is in a closed configuration relative to the frame such that substantially only a barrel of the second hinge assembly is viewable in the closed configuration.

9. The system of claim 8, wherein the third leaf includes a first section extending generally parallel to a second section.

10. The system of claim 9, wherein the third leaf includes a third section extending about perpendicular to both the first section and the second section;

wherein the third section is disposed between the first section the second section.

11. The system of claim 8, wherein the third leaf includes a step between a first section and a second section;

wherein only one of the first section or the second section is received within a pocket of the upper sash when the system is installed on the fold-up window assembly.

12. A fold up window assembly including the hardware system of claim 1.

13. A hardware system for use with a fold-up window assembly having an upper sash, a lower sash, and a frame, the hardware system comprising:

a slide locking assembly configured to selectively couple the lower sash to the frame of the window assembly, the slide locking assembly including:

a track member configured to be fixed and recessed in a groove formed in an upper rail of the lower sash; and a locking bar received within and movable relative to the track member;

a first hinge assembly configured to interconnect the lower sash and the upper sash; and a second hinge assembly configured to interconnect the upper sash and a header of the frame;

wherein, when the hardware system is installed on the fold-up window assembly, at least the first hinge assembly and the second hinge assembly cooperate with the upper sash and the lower sash to allow the upper sash and the lower sash to fold relative to the frame such that the upper sash rotates around a second hinge pin of the second hinge assembly near the header of the frame and the lower sash rotates around a first hinge pin as the upper sash and lower sash fold between a closed position and an open position and placement of the track member within the groove allows the lower sash to lie flush against the upper sash to allow the upper sash and the lower sash to assist in providing an appropriate seal in the closed position.

14. A fold-up window assembly including the hardware system of claim 13.

15. The system of claim 14, further comprising:

a handle;

an axle configured to extend from the handle through a bore formed in the lower sash, wherein the axle extends towards the groove formed in the lower sash;

a gear engaged by the axle; and a rack member fixed to the locking bar;

wherein the gear engages the rack member.

16. The system of claim 15, wherein a leaf of the first hinge assembly is positioned over the slide locking assembly that is recessed in the lower sash.

17. A hardware system for use with a fold-up window assembly having an upper sash a lower sash, and a frame, the hardware system comprising:

a balance assembly including:

a case configured to be fixed to the frame above the lower sash when the window assembly is in a closed configuration;

a spring member received within the case, the spring member configured to be coupled to the lower sash to apply a force to the lower sash;

a sash carrier having at least one housing member;

a friction enhancement member carried by the sash carrier and configured to engage a iamb channel of the frame to resist a spring force of the spring member; and a pin configured to extend from the lower sash and interconnect the spring member and the lower sash;

a first hinge assembly configured to interconnect the lower sash and the upper sash; and a second hinge assembly configured to interconnect the upper sash and a header of the frame;

wherein, when the hardware system is installed on the fold-up window assembly, at least the first hinge assembly and the second hinge assembly are configured to cooperate with the upper sash and the lower sash to allow the upper sash and the lower sash to fold relative to the frame; and wherein the spring member assists in moving the lower sash at least to move the window assembly to an open configuration.

18. The system of claim 17, wherein the balance assembly further includes:

a roller bearing positioned within the friction enhancement member;

wherein the pin is configured to pass through a bore of the roller bearing within the sash carrier.

19. The system of claim 17, wherein the spring member includes a coil spring wound around a first axis;

wherein the friction enhancement member is configured to rotate around a second axis;

wherein the first axis is perpendicular to the second axis.

20. The system of claim 17, wherein the spring member includes a coil spring wound around an axis and the spring member is let out from the case or retracted into the case such that a flat surface of the spring member is facing an interior of the frame;

wherein the friction enhancement member is configured to rotate around an axis that is perpendicular to an axis around which the spring member is configured to rotate.

21. The system of claim 17, wherein the case includes:

a nest configured to hold the spring member within the case; and a projection extending from a sidewall of the case to assist in holding the spring member within the nest.

22. The system of claim 17, further comprising:

a spring pin;

wherein the spring member is a coil spring wound around the spring pin;

wherein the spring pin engages a wall of the case.

23. The system of claim 17, further comprising:

a jamb channel insert including:

a first jamb channel member and a second jamb channel member;

a first barb extending from the first jamb channel member and a second barb extending from the second jamb channel member;

wherein the first jamb channel insert and the second jamb channel insert are configured to be inserted separately into a jamb channel of the frame and the first barb and the second barb resist removal of the jamb channel insert from the jamb channel.

24. A fold-up window assembly comprising:

a frame;

an upper sash;

a lower sash; and a hardware system configured to allow the upper sash and the lower sash to fold up to an open configuration and to unfold to a closed configuration, the hardware system including:

a balance assembly including:

a case fixed to the frame above the lower sash when the window assembly is in the closed configuration, a spring member at least partially received within the case and coupled to the lower sash to apply a force to the lower sash;

a sash carrier having at least one housing member;

a friction enhancement member carried by the sash carrier and configured to engage a iamb channel of the frame to resist a spring force of the spring member; and a pin configured to extend from the lower sash and interconnect the spring member and the lower sash;

wherein the spring member assists in moving the lower sash at least to move the window assembly to the open configuration.

25. The assembly of claim 24, further comprising:

a first hinge assembly interconnecting the lower sash and the upper sash; and a second hinge assembly interconnecting the upper sash and a header of the frame;

wherein at least the first hinge assembly and the second hinge assembly cooperate with the upper sash and the lower sash to allow the upper sash and the lower sash to fold and unfold relative to the frame.

26. The assembly of claim 24, wherein the spring member includes a coil spring wound around a first axis;

wherein the friction enhancement member includes a curved surface to engage the jamb channel to resist the spring force;

wherein the curved surface is formed around a second axis;

wherein the first axis is perpendicular to the second axis.

* * * * *